US008533974B2

(12) United States Patent
Burnett

(10) Patent No.: US 8,533,974 B2
(45) Date of Patent: Sep. 17, 2013

(54) RECLAMATION OF COMPONENTS OF WELLBORE CUTTINGS MATERIAL

(71) Applicant: Varco I/P, Inc., Houston, TX (US)

(72) Inventor: George Alexander Burnett, Aberdeen (GB)

(73) Assignee: Varco I/P, Inc., Houston, TX (US)

( * ) Notice: Subject to any disclaimer, the term of this patent is extended or adjusted under 35 U.S.C. 154(b) by 0 days.

(21) Appl. No.: 13/658,269

(22) Filed: Oct. 23, 2012

(65) Prior Publication Data

US 2013/0067762 A1 Mar. 21, 2013

Related U.S. Application Data

(60) Continuation of application No. 12/469,851, filed on May 21, 2009, now Pat. No. 8,316,557, which is a division of application No. 11/543,301, filed on Oct. 4, 2006, now abandoned.

(51) Int. Cl.
*F26B 17/00* (2006.01)

(52) U.S. Cl.
USPC ..... 34/579; 34/580; 34/586; 34/591; 34/61; 34/102; 166/60; 166/303; 175/66; 175/206; 96/401; 96/402; 100/45; 100/117

(58) Field of Classification Search
USPC ..... 34/359, 576, 579, 580, 586, 591, 34/61, 102; 166/45, 60, 302, 303; 96/401, 96/402; 175/66, 206; 100/45, 117
See application file for complete search history.

(56) References Cited

U.S. PATENT DOCUMENTS

| | | | | |
|---|---|---|---|---|
| 399,616 | A | 3/1889 | Riddle | 209/238 |
| 485,488 | A | 11/1892 | Cockrell | 209/401 |
| 1,078,380 | A | 11/1913 | Reynolds | |
| 1,139,469 | A | 5/1915 | Potter | 209/401 |

(Continued)

FOREIGN PATENT DOCUMENTS

| | | | |
|---|---|---|---|
| DE | 3819462 | C1 * | 5/1990 |
| DE | 4127929 | A1 | 2/1993 |

(Continued)

OTHER PUBLICATIONS

International Search Report from PCT/GB2011/050975 dated Nov. 15, 2012.

(Continued)

*Primary Examiner* — Steve M Gravini
(74) *Attorney, Agent, or Firm* — Williams, Morgan & Amerson, P.C.

(57) ABSTRACT

The present disclosure is generally directed to systems that are used for reclaiming components of wellbore cuttings material. In one illustrative embodiment, a system is disclosed that includes, among other things, a dryer that is adapted to receive a drill cuttings mixture that includes drilling fluid and cuttings material, the dryer being further adapted to treat the drill cuttings mixture by drying the cuttings material below a preselected moisture content level. The system also includes a moisture sensor that is adapted to sense a moisture content of the cuttings material after it is dried by the dryer, and a cuttings reinjection system that is adapted to reinject the dried cuttings material into a well bore. Additionally, the system includes a conveyor system that is adapted to convey the dried cuttings material to the cuttings reinjection system, wherein the conveyor system includes, among other things, a positive pressure pneumatic conveying apparatus.

21 Claims, 4 Drawing Sheets

(56) References Cited

U.S. PATENT DOCUMENTS

| | | | | |
|---|---|---|---|---|
| 1,304,918 | A | 5/1919 | Sweetland | |
| 1,459,845 | A | 6/1923 | Mitchell | |
| 1,830,792 | A | 11/1931 | Herrmann | 209/401 |
| 1,885,154 | A | 11/1932 | Strezynski et al. | |
| 1,886,174 | A | 11/1932 | Hazeltine | 209/269 |
| 1,997,713 | A | 4/1935 | Boehm | 298/401 |
| 2,082,513 | A | 6/1937 | Roberts | 210/76 |
| 2,089,548 | A | 8/1937 | Frantz et al. | 210/389 |
| 2,112,784 | A | 3/1938 | McNitt | 99/105 |
| 2,341,169 | A | 2/1944 | Wilson et al. | 73/51 |
| 2,418,529 | A | 4/1947 | Stern | 51/309 |
| 2,578,456 | A | 12/1951 | Smith | 233/7 |
| 2,653,521 | A | 9/1953 | Einarsson | 209/70 |
| 2,711,854 | A | 6/1955 | Kjellgren | 494/53 |
| 2,716,493 | A | 8/1955 | Hutchison | 209/269 X |
| 2,750,043 | A | 6/1956 | Thompson | 210/149 |
| 2,895,669 | A | 7/1959 | Bobo | 494/10 |
| 2,919,898 | A | 1/1960 | Marwil et al. | 255/1.8 |
| 2,926,785 | A | 3/1960 | Sander | 209/401 |
| 2,928,546 | A | 3/1960 | Church | 210/319 |
| 2,938,393 | A | 5/1960 | Dunn et al. | 74/61 |
| 2,942,731 | A | 6/1960 | Soldini | 209/293 |
| 2,955,753 | A | 10/1960 | O'Conor et al. | 494/5 |
| 2,961,154 | A | 11/1960 | Bergey | 494/1 |
| 2,973,865 | A | 5/1961 | Cibula | 209/315 |
| 3,012,674 | A | 12/1961 | Hoppe | 209/401 |
| 3,053,379 | A | 9/1962 | Roder et al. | 198/220 |
| 3,064,806 | A | 11/1962 | Tapani | 209/17 |
| 3,070,291 | A | 12/1962 | Bergey | 494/1 |
| 3,219,107 | A | 11/1965 | Brown et al. | 166/8 |
| 3,226,989 | A | 1/1966 | Robins | 74/87 |
| 3,268,159 | A | 8/1966 | Kern | 233/7 |
| 3,302,720 | A | 2/1967 | Brandon | 166/42 |
| 3,498,393 | A | 3/1970 | West et al. | 175/48 |
| 3,605,919 | A | 9/1971 | Bromell et al. | 175/27 |
| 3,629,859 | A | 12/1971 | Copland et al. | 340/172.5 |
| 3,640,344 | A | 2/1972 | Brandon | 166/307 |
| 3,659,465 | A | 5/1972 | Oshima et al. | 74/61 |
| 3,716,138 | A | 2/1973 | Lumsden | 209/401 |
| 3,726,136 | A | 4/1973 | McKean et al. | 73/155 |
| 3,795,361 | A | 3/1974 | Lee | 233/7 |
| 3,796,299 | A | 3/1974 | Musschoot | 198/220 |
| 3,855,380 | A | 12/1974 | Gordon et al. | 264/97 |
| 3,874,733 | A | 4/1975 | Poundstone et al. | 299/17 |
| 3,885,734 | A | 5/1975 | Lee | 233/3 |
| 3,900,393 | A | 8/1975 | Wilson | 209/399 |
| 3,934,792 | A | 1/1976 | High et al. | 233/7 |
| 3,955,411 | A | 5/1976 | Lawson, Jr. | 73/155 |
| 3,968,033 | A | 7/1976 | Illemann et al. | 209/403 |
| 3,993,146 | A | 11/1976 | Poundstone et al. | 175/206 |
| 4,000,074 | A | 12/1976 | Evans | 210/369 |
| 4,033,865 | A | 7/1977 | Derrick, Jr. | 209/275 |
| 4,038,152 | A | 7/1977 | Atkins | 201/2.5 |
| 4,082,657 | A | 4/1978 | Gage | 209/311 |
| 4,085,888 | A | 4/1978 | Jager | 233/7 |
| 4,115,507 | A | 9/1978 | Pico et al. | 264/267 |
| 4,116,288 | A | 9/1978 | Love | 175/66 |
| 4,192,743 | A | 3/1980 | Bastgen et al. | 210/712 |
| 4,208,906 | A | 6/1980 | Roberts, Jr. | 73/155 |
| 4,212,731 | A | 7/1980 | Wallin et al. | 209/366.5 |
| 4,222,988 | A | 9/1980 | Barthel | 422/309 |
| 4,224,821 | A | 9/1980 | Taylor et al. | 73/32 R |
| 4,228,949 | A | 10/1980 | Jackson | 233/7 |
| 4,233,181 | A | 11/1980 | Goller et al. | 252/425.3 |
| 4,240,578 | A | 12/1980 | Jackson | 233/7 |
| 4,297,225 | A | 10/1981 | Hartley | 210/779 |
| 4,298,160 | A | 11/1981 | Jackson | 233/7 |
| 4,298,162 | A | 11/1981 | Hohne | 233/7 |
| 4,298,572 | A | 11/1981 | Moffet et al. | 422/68 |
| 4,306,974 | A | 12/1981 | Harry | 210/388 |
| 4,319,482 | A | 3/1982 | Bunner | 73/153 |
| 4,319,991 | A | 3/1982 | Crone, Jr. et al. | 209/255 |
| 4,322,288 | A | 3/1982 | Schmidt | 209/356 |
| 4,339,072 | A | 7/1982 | Hiller | 233/7 |
| 4,350,591 | A | 9/1982 | Lee | 210/384 |
| 4,369,915 | A | 1/1983 | Oberg et al. | 494/8 |
| 4,378,906 | A | 4/1983 | Epper et al. | 494/54 |
| 4,380,494 | A | 4/1983 | Wilson | 290/319 |
| 4,411,074 | A | 10/1983 | Daly | 34/32 |
| 4,432,064 | A | 2/1984 | Barker et al. | 364/550 |
| 4,446,022 | A | 5/1984 | Harry | 210/388 |
| 4,459,207 | A | 7/1984 | Young | 209/269 |
| 4,482,459 | A | 11/1984 | Shiver | 210/639 |
| 4,491,517 | A | 1/1985 | Janovac | 209/401 |
| 4,495,065 | A | 1/1985 | DeReamer et al. | 209/243 |
| 4,526,687 | A | 7/1985 | Nugent | 210/202 |
| 4,536,286 | A | 8/1985 | Nugent | 210/202 |
| 4,546,783 | A | 10/1985 | Lott | 134/109 |
| 4,549,431 | A | 10/1985 | Soeiinah | 73/152.49 |
| 4,553,429 | A | 11/1985 | Evans et al. | 73/152.21 |
| 4,573,115 | A | 2/1986 | Halgrimson | 364/138 |
| 4,575,336 | A | 3/1986 | Mudd et al. | 432/72 |
| 4,575,421 | A | 3/1986 | Derrick et al. | 298/397 |
| 4,606,415 | A | 8/1986 | Gray, Jr. et al. | 175/24 |
| 4,624,417 | A | 11/1986 | Gangi | 241/17 |
| 4,634,535 | A | 1/1987 | Lott | 210/780 |
| 4,635,735 | A | 1/1987 | Crownover | 175/48 |
| 4,639,258 | A | 1/1987 | Schellstede et al. | 95/260 |
| 4,650,687 | A | 3/1987 | Willard et al. | 426/438 |
| 4,668,213 | A | 5/1987 | Kramer | 494/8 |
| 4,685,329 | A | 8/1987 | Burgess | 73/151 |
| 4,691,744 | A | 9/1987 | Haver et al. | 139/425 R |
| 4,696,353 | A | 9/1987 | Elmquist et al. | 175/206 |
| 4,696,751 | A | 9/1987 | Eifling | 210/780 |
| 4,729,548 | A | 3/1988 | Sullins | 266/44 |
| 4,743,226 | A | 5/1988 | Day et al. | 494/53 |
| 4,751,887 | A | 6/1988 | Terry et al. | 110/246 |
| 4,770,711 | A | 9/1988 | Deal, III et al. | 134/18 |
| 4,783,057 | A | 11/1988 | Sullins | 266/44 |
| 4,791,002 | A | 12/1988 | Baker et al. | 426/641 |
| 4,793,421 | A | 12/1988 | Jasinski | 175/27 |
| 4,795,552 | A | 1/1989 | Yun et al. | 209/319 |
| 4,799,987 | A | 1/1989 | Sullins | 156/425 |
| 4,805,659 | A | 2/1989 | Gunneweg et al. | 137/118 |
| 4,807,469 | A | 2/1989 | Hall | 73/155 |
| 4,809,791 | A | 3/1989 | Hayatdavoudi | 175/40 |
| 4,832,853 | A | 5/1989 | Shiraki et al. | 210/781 |
| 4,844,106 | A | 7/1989 | Hunter et al. | 134/73 |
| 4,846,352 | A | 7/1989 | Bailey | 209/399 |
| 4,857,176 | A | 8/1989 | Derrick et al. | 209/392 |
| 4,882,054 | A | 11/1989 | Derrick et al. | 210/389 |
| 4,889,733 | A | 12/1989 | Willard et al. | 426/438 |
| 4,889,737 | A | 12/1989 | Willard et al. | 426/550 |
| 4,895,665 | A | 1/1990 | Colelli et al. | 210/710 |
| 4,895,731 | A | 1/1990 | Baker et al. | 426/641 |
| 4,896,835 | A | 1/1990 | Fahrenholz | 241/74 |
| 4,911,834 | A | 3/1990 | Murphy | 210/167 |
| 4,915,452 | A | 4/1990 | Dibble | 299/17 |
| 4,940,535 | A | 7/1990 | Fisher et al. | 209/250 |
| 4,942,929 | A | 7/1990 | Malachosky et al. | 175/66 |
| 4,961,722 | A | 10/1990 | Taylor et al. | 494/36 |
| 5,010,966 | A | 4/1991 | Stokley et al. | 175/66 |
| 5,053,082 | A | 10/1991 | Flanigan et al. | 134/25.1 |
| 5,066,350 | A | 11/1991 | Sullins | 156/187 |
| 5,080,721 | A | 1/1992 | Flanigan et al. | 134/26 |
| 5,107,874 | A | 4/1992 | Flanigan et al. | 134/60 |
| 5,109,933 | A | 5/1992 | Jackson | 175/66 |
| 5,129,469 | A | 7/1992 | Jackson | 175/66 |
| 5,131,271 | A | 7/1992 | Haynes et al. | 73/290 |
| 5,145,256 | A | 9/1992 | Wiemers et al. | 366/336 |
| 5,147,277 | A | 9/1992 | Shapiro | 494/53 |
| 5,156,749 | A | 10/1992 | Williams | 210/770 |
| 5,156,751 | A | 10/1992 | Miller | 210/787 |
| 5,181,578 | A | 1/1993 | Lawler | 175/424 |
| 5,190,645 | A | 3/1993 | Burgess | 210/144 |
| 5,200,372 | A | 4/1993 | Kuroyama et al. | 501/96 |
| 5,203,762 | A | 4/1993 | Cooperstein | 494/7 |
| 5,221,008 | A | 6/1993 | Derrick, Jr. et al. | 209/269 |
| 5,226,546 | A | 7/1993 | Janssens et al. | 209/319 |
| 5,227,057 | A | 7/1993 | Lundquist | 210/174 |
| 5,229,018 | A | 7/1993 | Forrest | 252/8.551 |
| 5,232,099 | A | 8/1993 | Maynard | 209/311 |
| 5,253,718 | A | 10/1993 | Lawler | 175/20 |
| 5,256,291 | A | 10/1993 | Cagle | 210/499 |

5,265,730 A 11/1993 Norris et al. ..... 209/326
5,273,112 A 12/1993 Schultz ..... 166/374
5,278,549 A 1/1994 Crawford ..... 340/853.2
5,314,058 A 5/1994 Graham ..... 198/753
5,319,972 A 6/1994 Oblak et al. ..... 73/290
5,329,465 A 7/1994 Arcella et al. ..... 364/551.01
5,330,057 A 7/1994 Schiller et al. ..... 209/392
5,332,101 A 7/1994 Bakula ..... 209/403
5,337,966 A 8/1994 Francis et al. ..... 241/46.06
5,370,797 A 12/1994 Cagle ..... 210/499
5,378,364 A 1/1995 Welling ..... 210/512.1
5,385,669 A 1/1995 Leone, Sr. ..... 210/488
5,392,925 A 2/1995 Seyffert ..... 209/405
5,400,376 A 3/1995 Trudeau ..... 377/21
5,403,260 A 4/1995 Hensely ..... 494/53
5,417,793 A 5/1995 Bakula ..... 156/308.2
5,417,858 A 5/1995 Derrick et al. ..... 210/388
5,417,859 A 5/1995 Bakula ..... 210/388
5,454,957 A 10/1995 Roff ..... 210/768
5,465,798 A 11/1995 Edlund et al. ..... 175/24
5,474,142 A 12/1995 Bowden ..... 175/27
5,488,104 A 1/1996 Schulz ..... 536/86
5,489,204 A 2/1996 Conwell et al. ..... 432/153
5,494,584 A 2/1996 McLachlan et al. ..... 210/739
5,516,348 A 5/1996 Conwell et al. ..... 51/309
5,534,207 A 7/1996 Burrus ..... 264/150
5,547,479 A 8/1996 Conwell et al. ..... 51/309
5,566,889 A 10/1996 Preiss ..... 241/19
5,567,150 A 10/1996 Conwell et al. ..... 432/14
5,570,749 A 11/1996 Reed ..... 175/66
5,593,582 A 1/1997 Roff, Jr. ..... 210/325
5,597,042 A 1/1997 Tubel et al. ..... 166/250.01
5,626,234 A 5/1997 Cook et al. ..... 209/315
5,632,714 A 5/1997 Leung et al. ..... 494/53
5,636,749 A 6/1997 Wojciechowski ..... 209/403
5,638,960 A 6/1997 Beuermann et al. ..... 209/397
5,641,070 A 6/1997 Seyffert ..... 209/314
5,643,169 A 7/1997 Leung et al. ..... 494/53
5,653,674 A 8/1997 Leung ..... 494/53
5,662,165 A 9/1997 Tubel et al. ..... 166/250.01
5,669,941 A 9/1997 Peterson ..... 51/295
5,681,256 A 10/1997 Nagafuji ..... 494/9
D386,874 S 11/1997 Glaun ..... D34/29
D387,534 S 12/1997 Glaun ..... D34/29
D388,583 S 12/1997 Glaun ..... D34/29
5,695,442 A 12/1997 Leung et al. ..... 494/37
5,699,918 A 12/1997 Dunn ..... 209/397
D388,924 S 1/1998 Glaun ..... D34/29
5,706,896 A 1/1998 Tubel et al. ..... 166/313
5,720,881 A 2/1998 Derrick et al. ..... 210/388
5,730,219 A 3/1998 Tubel et al. ..... 166/250.01
5,732,776 A 3/1998 Tubel et al. ..... 166/250.15
5,732,828 A 3/1998 Littlefield, Jr. ..... 209/365.1
5,771,601 A 6/1998 Veal et al. ..... 34/314
5,772,573 A 6/1998 Hao ..... 494/15
5,783,077 A 7/1998 Bakula ..... 210/388
5,791,494 A 8/1998 Meyer ..... 209/368
5,793,705 A 8/1998 Gazis et al. ..... 367/98
5,811,003 A 9/1998 Young et al. ..... 210/388
5,814,218 A 9/1998 Cagle ..... 210/388
5,814,230 A 9/1998 Willis et al. ..... 210/710
5,816,413 A 10/1998 Boccabella et al. ..... 209/399
5,819,952 A 10/1998 Cook et al. ..... 209/400
5,839,521 A 11/1998 Dietzen ..... 100/37
5,857,955 A 1/1999 Phillips ..... 494/7
5,861,362 A 1/1999 Mayeux et al. ..... 507/104
5,868,125 A 2/1999 Maoujoud ..... 125/15
5,868,929 A 2/1999 Derrick et al. ..... 210/388
5,876,552 A 3/1999 Bakula ..... 156/308
5,896,998 A 4/1999 Bjorklund et al. ..... 209/326
5,899,844 A 5/1999 Eberle, Sr. ..... 494/37
5,913,767 A 6/1999 Feldkamp et al. ..... 494/4
5,919,123 A 7/1999 Phillips ..... 494/7
5,942,130 A 8/1999 Leung ..... 210/784
5,944,197 A 8/1999 Baltzer et al. ..... 209/400
5,944,993 A 8/1999 Derrick et al. ..... 210/388
5,948,256 A 9/1999 Leung ..... 210/374
5,948,271 A 9/1999 Wardwell et al. ..... 210/739
5,952,569 A 9/1999 Jervis et al. ..... 73/152.01
5,955,666 A 9/1999 Mullins ..... 73/152.18
5,958,235 A 9/1999 Leung ..... 210/374
5,958,236 A 9/1999 Bakula ..... 210/388
5,971,159 A 10/1999 Leone et al. ..... 209/399
5,971,307 A 10/1999 Davenport ..... 241/259.1
5,975,204 A 11/1999 Tubel et al. ..... 166/250.15
5,992,519 A 11/1999 Ramakrishnan et al. 166/250.15
6,000,556 A 12/1999 Bakula ..... 210/388
6,012,016 A 1/2000 Bilden et al. ..... 702/12
6,013,158 A 1/2000 Wootten ..... 202/99
6,021,377 A 2/2000 Dubinsky et al. ..... 702/9
6,024,228 A 2/2000 Williams ..... 209/272
6,032,806 A 3/2000 Leone et al. ..... 209/402
6,045,070 A 4/2000 Davenport ..... 241/60
6,053,332 A 4/2000 Bakula ..... 210/388
6,062,070 A 5/2000 Maltby et al. ..... 73/61.49
6,063,292 A 5/2000 Leung ..... 210/739
6,089,380 A 7/2000 Hazrati et al. ..... 210/411
6,102,310 A 8/2000 Davenport ..... 241/21
6,105,689 A 8/2000 McGuire et al. ..... 175/48
6,109,452 A 8/2000 Leung et al. ..... 210/369
6,110,096 A 8/2000 Leung et al. ..... 494/53
6,123,656 A 9/2000 Michelsen ..... 494/54
6,138,834 A 10/2000 Southall ..... 209/17
6,143,183 A 11/2000 Wardwell et al. ..... 210/739
6,145,669 A 11/2000 Leung ..... 210/374
6,155,428 A 12/2000 Bailey et al. ..... 209/315
6,161,700 A 12/2000 Bakula ..... 209/401
6,165,323 A 12/2000 Shearer ..... 162/251
6,170,580 B1 1/2001 Reddoch ..... 175/66
6,173,609 B1 1/2001 Modlin et al. ..... 73/293
6,176,323 B1 1/2001 Weirich et al. ..... 175/40
6,179,128 B1 1/2001 Seyffert ..... 209/405
6,192,742 B1 2/2001 Miwa et al. ..... 73/40
6,192,980 B1 2/2001 Tubel et al. ..... 166/65.1
6,217,830 B1 4/2001 Roberts et al. ..... 422/140
6,220,448 B1 4/2001 Bakula et al. ..... 209/392
6,220,449 B1 4/2001 Schulte, Jr. et al. ..... 209/401
6,223,906 B1 5/2001 Williams ..... 210/400
6,233,524 B1 5/2001 Harrell et al. ..... 702/9
6,234,250 B1 5/2001 Green et al. ..... 166/250.03
6,237,404 B1 5/2001 Crary et al. ..... 73/152.03
6,237,780 B1 5/2001 Schulte ..... 210/388
6,267,250 B1 7/2001 Leung et al. ..... 210/369
6,279,471 B1 8/2001 Reddoch ..... 100/37
D448,488 S 9/2001 Chaffiotte et al. ..... D24/219
6,283,302 B1 9/2001 Schulte et al. ..... 209/399
6,290,636 B1 9/2001 Hiller, Jr. et al. ..... 494/53
6,308,787 B1 10/2001 Alft ..... 175/48
6,315,894 B1 11/2001 Wiemers et al. ..... 210/96.1
6,333,700 B1 12/2001 Thomeer et al. ..... 340/854.8
6,346,813 B1 2/2002 Kleinberg ..... 324/303
6,349,834 B1 2/2002 Carr et al. ..... 209/366.5
6,352,159 B1 3/2002 Loshe ..... 209/268
6,356,205 B1 3/2002 Salvo et al. ..... 340/853.3
6,367,633 B1 4/2002 Douglas ..... 209/311
6,368,264 B1 4/2002 Phillips et al. ..... 494/5
6,371,301 B1 4/2002 Schulte et al. ..... 209/405
6,371,306 B2 4/2002 Adams et al. ..... 320/388
6,378,628 B1 4/2002 McGuire et al. ..... 175/48
6,393,363 B1 5/2002 Wilt et al. ..... 702/6
6,399,851 B1 6/2002 Siddle ..... 203/87
6,408,953 B1 6/2002 Goldman et al. ..... 175/39
6,412,644 B1 7/2002 Crabbe et al. ..... 209/309
6,429,653 B1 8/2002 Kruspe et al. ..... 324/303
6,431,368 B1 8/2002 Carr ..... 209/403
6,438,495 B1 8/2002 Chau et al. ..... 702/9
6,439,391 B1 8/2002 Seyffert ..... 209/238
6,439,392 B1 8/2002 Baltzer ..... 209/405
6,461,286 B1 10/2002 Beatley ..... 494/8
6,474,143 B1 11/2002 Herod ..... 73/54.01
6,484,088 B1 11/2002 Reimer ..... 701/123
6,485,640 B2 11/2002 Fout et al. ..... 210/188
6,505,682 B2 1/2003 Brockman ..... 166/250.15
6,506,310 B2 1/2003 Kulbeth ..... 210/780
6,510,947 B1 1/2003 Schulte et al. ..... 210/388
6,513,664 B1 2/2003 Logan et al. ..... 209/367
6,517,733 B1 2/2003 Carlson ..... 210/785
6,519,568 B1 2/2003 Harvey et al. ..... 705/1

| | | | | |
|---|---|---|---|---|
| 6,530,482 | B1 | 3/2003 | Wiseman | 209/253 |
| 6,536,540 | B2 | 3/2003 | deBoer | 175/70 |
| 6,553,316 | B2 | 4/2003 | Bary et al. | 702/16 |
| 6,553,336 | B1 | 4/2003 | Johnson et al. | 702/188 |
| 6,575,304 | B2 | 6/2003 | Cudahy | 209/365.3 |
| 6,581,455 | B1 | 6/2003 | Berger et al. | 73/152.55 |
| 6,600,278 | B1 | 7/2003 | Bretzius | 318/34 |
| 6,601,709 | B2 | 8/2003 | Schulte et al. | 209/397 |
| 6,605,029 | B1 | 8/2003 | Koch et al. | 494/53 |
| 6,662,952 | B2 | 12/2003 | Adams et al. | 209/319 |
| 6,669,027 | B1 | 12/2003 | Mooney et al. | 209/405 |
| 6,679,385 | B2 | 1/2004 | Suter et al. | 209/367 |
| 6,691,025 | B2 | 2/2004 | Reimer | 701/123 |
| 6,692,599 | B2 | 2/2004 | Cook et al. | 156/94 |
| 6,693,553 | B1 | 2/2004 | Ciglenec et al. | 340/853.1 |
| 6,715,612 | B1 | 4/2004 | Krystof | 209/331 |
| 6,722,504 | B2 | 4/2004 | Schulte et al. | 209/359 |
| 6,746,602 | B2 | 6/2004 | Fout et al. | 210/188 |
| 6,763,605 | B2 | 7/2004 | Reddoch | 34/58 |
| 6,766,254 | B1 | 7/2004 | Bradford et al. | 702/9 |
| 6,769,550 | B2 | 8/2004 | Adams et al. | 209/399 |
| 6,780,147 | B2 | 8/2004 | Koch et al. | 494/53 |
| 6,783,088 | B1 | 8/2004 | Gillis et al. | 241/19 |
| 6,783,685 | B2 | 8/2004 | Huang | 210/690 |
| 6,790,169 | B2 | 9/2004 | Koch et al. | 494/53 |
| 6,793,814 | B2 | 9/2004 | Fout et al. | 210/188 |
| 6,808,626 | B2 | 10/2004 | Kulbeth | 210/241 |
| 6,825,136 | B2 | 11/2004 | Cook et al. | 442/6 |
| 6,827,223 | B2 | 12/2004 | Colgrove et al. | 209/365.3 |
| 6,838,008 | B2 | 1/2005 | Fout et al. | 210/780 |
| 6,860,845 | B1 | 3/2005 | Miller et al. | 494/1 |
| 6,863,183 | B2 | 3/2005 | Schulte et al. | 209/405 |
| 6,863,809 | B2 | 3/2005 | Smith et al. | 210/202 |
| 6,868,920 | B2 | 3/2005 | Hoteit et al. | 175/25 |
| 6,868,972 | B2 | 3/2005 | Seyffert et al. | 209/254 |
| 6,873,267 | B1 | 3/2005 | Tubel et al. | 340/853.3 |
| 6,892,812 | B2 | 5/2005 | Niedermayr et al. | 166/250.15 |
| 6,896,055 | B2 | 5/2005 | Koithan | 166/250.15 |
| 6,899,178 | B2 | 5/2005 | Tubel | 166/313 |
| 6,905,452 | B1 | 6/2005 | Kirsch | 494/8 |
| 6,907,375 | B2 | 6/2005 | Guggari et al. | 702/113 |
| 6,926,101 | B2 | 8/2005 | deBoer | 175/70 |
| 6,932,169 | B2 | 8/2005 | Wylie et al. | 175/66 |
| 6,932,757 | B2 | 8/2005 | Beattey | 494/55 |
| 6,971,982 | B1 | 12/2005 | Kirsch | 494/8 |
| 6,981,940 | B2 | 1/2006 | Rafferty | 494/7 |
| 7,001,324 | B2 | 2/2006 | Hensley et al. | 494/53 |
| 7,018,326 | B2 | 3/2006 | Koch et al. | 494/53 |
| 7,041,044 | B2 | 5/2006 | Gilbert | 494/53 |
| D524,825 | S | 7/2006 | Koch et al. | D15/21 |
| 7,093,678 | B2 | 8/2006 | Risher et al. | 175/66 |
| 7,144,516 | B2 | 12/2006 | Smith | 210/803 |
| 7,175,027 | B2 | 2/2007 | Strong et al. | 209/405 |
| 7,195,084 | B2 * | 3/2007 | Burnett et al. | 175/66 |
| 7,198,156 | B2 | 4/2007 | Schulte et al. | 209/309 |
| 7,216,767 | B2 | 5/2007 | Schulte et al. | 209/309 |
| 7,216,768 | B2 | 5/2007 | Fisher et al. | 209/309 |
| 7,228,971 | B2 | 6/2007 | Mooney et al. | 209/396 |
| 7,264,125 | B2 | 9/2007 | Lipa | 209/397 |
| 7,284,665 | B2 | 10/2007 | Fuchs | 209/270 |
| 7,303,079 | B2 | 12/2007 | Reid-Robertson et al. | 209/405 |
| 7,306,057 | B2 | 12/2007 | Strong et al. | 175/66 |
| 7,316,321 | B2 | 1/2008 | Robertson et al. | 209/400 |
| 7,337,860 | B2 | 3/2008 | McIntyre | 175/66 |
| 7,373,996 | B1 | 5/2008 | Martin et al. | 175/206 |
| 7,387,602 | B1 | 6/2008 | Kirsch | 494/8 |
| 7,484,574 | B2 * | 2/2009 | Burnett et al. | 175/66 |
| 7,514,011 | B2 | 4/2009 | Kulbeth | 210/780 |
| 7,540,837 | B2 | 6/2009 | Scott et al. | 494/7 |
| 7,540,838 | B2 | 6/2009 | Scott et al. | 494/7 |
| 7,581,569 | B2 | 9/2009 | Beck | 139/425 R |
| 7,770,665 | B2 | 8/2010 | Eia et al. | 175/66 |
| 2001/0032815 | A1 | 10/2001 | Adams et al. | 210/388 |
| 2002/0000399 | A1 | 1/2002 | Winkler et al. | 209/399 |
| 2002/0018399 | A1 | 2/2002 | Schultz et al. | 361/81 |
| 2002/0033278 | A1 | 3/2002 | Reddoch | 175/57 |
| 2002/0033358 | A1 | 3/2002 | Bakula | 209/331 |
| 2002/0035551 | A1 | 3/2002 | Sherwin et al. | 705/412 |
| 2002/0065698 | A1 | 5/2002 | Schick et al. | 705/8 |
| 2002/0112888 | A1 | 8/2002 | Leuchtenberg | 175/48 |
| 2002/0134709 | A1 | 9/2002 | Riddle | 209/238 |
| 2003/0015351 | A1 | 1/2003 | Goldman et al. | 175/39 |
| 2003/0038734 | A1 | 2/2003 | Hirsch et al. | 340/853.1 |
| 2003/0109951 | A1 | 6/2003 | Hsiung et al. | 700/108 |
| 2003/0220742 | A1 | 11/2003 | Niedermayr et al. | 702/9 |
| 2004/0040746 | A1 | 3/2004 | Niedermayr et al. | 175/38 |
| 2004/0051650 | A1 | 3/2004 | Gonsoulin et al. | 340/853.1 |
| 2004/0156920 | A1 | 8/2004 | Kane | 424/725 |
| 2004/0245155 | A1 | 12/2004 | Strong et al. | 209/405 |
| 2005/0067327 | A1 | 3/2005 | Adams et al. | 209/408 |
| 2005/0103689 | A1 | 5/2005 | Schulte, Jr. et al. | 209/405 |
| 2005/0236305 | A1 | 10/2005 | Schulte, Jr. et al. | 209/403 |
| 2005/0255186 | A1 | 11/2005 | Hiraga | 425/542 |
| 2006/0019812 | A1 | 1/2006 | Stalwick | 494/42 |
| 2006/0034988 | A1 | 2/2006 | Bresnahan et al. | 426/502 |
| 2006/0081508 | A1 | 4/2006 | Astleford et al. | 209/309 |
| 2006/0102390 | A1 | 5/2006 | Burnett et al. | 175/66 |
| 2006/0105896 | A1 | 5/2006 | Smith et al. | 494/7 |
| 2006/0144779 | A1 | 7/2006 | Bailey | 210/330 |
| 2007/0108106 | A1 | 5/2007 | Burnett | 209/325 |
| 2007/0131592 | A1 | 6/2007 | Browne et al. | 209/399 |
| 2008/0078697 | A1 | 4/2008 | Carr | 209/49 |
| 2008/0078702 | A1 | 4/2008 | Carr et al. | 209/326 |
| 2008/0078704 | A1 | 4/2008 | Carr et al. | 209/399 |
| 2008/0093269 | A1 | 4/2008 | Timmerman et al. | 209/405 |
| 2008/0179090 | A1 | 7/2008 | Eia et al. | 175/5 |
| 2008/0179096 | A1 | 7/2008 | Eia et al. | 175/66 |
| 2008/0179097 | A1 | 7/2008 | Eia et al. | 175/66 |
| 2009/0071878 | A1 | 3/2009 | Bosse | 209/391 |
| 2009/0105059 | A1 | 4/2009 | Dorry et al. | 494/37 |
| 2009/0178978 | A1 | 7/2009 | Beebe et al. | 210/747 |
| 2009/0242466 | A1 | 10/2009 | Burnett et al. | 209/555 |
| 2009/0272535 | A1 * | 11/2009 | Burns et al. | 166/302 |
| 2009/0286098 | A1 | 11/2009 | Yajima et al. | 428/507 |
| 2009/0316084 | A1 | 12/2009 | Yajima et al. | 349/96 |
| 2010/0084190 | A1 | 4/2010 | Eia et al. | 175/5 |
| 2010/0089802 | A1 | 4/2010 | Burnett | 209/360 |
| 2010/0101783 | A1 * | 4/2010 | Vinegar et al. | 166/247 |
| 2010/0119570 | A1 | 5/2010 | Potter et al. | 424/422 |
| 2010/0237024 | A1 | 9/2010 | Carr et al. | 210/780 |
| 2013/0067762 | A1 * | 3/2013 | Burnett | 34/359 |

FOREIGN PATENT DOCUMENTS

| | | | |
|---|---|---|---|
| EP | 289668 | A1 * | 11/1988 |
| FR | 2 611 559 | | 9/1988 |
| FR | 2 636 669 | | 3/1990 |
| GB | 1 526 663 | | 9/1978 |
| GB | 2 030 482 | A | 4/1980 |
| GB | 1 578 948 | | 11/1980 |
| GB | 2 176 424 | A | 12/1986 |
| GB | 2 327 442 | A | 1/1999 |
| GB | 2 408 006 | B | 4/2007 |
| GB | 2448683 | A * | 10/2008 |
| JP | 55112761 | | 8/1980 |
| JP | 59069268 | | 4/1984 |
| JP | 63003090 | | 1/1988 |
| JP | 63283860 | | 11/1988 |
| JP | 63290705 | | 11/1988 |
| JP | 02127030 | | 5/1990 |
| JP | 02167834 | | 6/1990 |
| JP | 03240925 | | 10/1991 |
| JP | 03264263 | | 11/1991 |
| JP | 04093045 | | 3/1992 |
| JP | 04269170 | | 9/1992 |
| JP | 05043884 | | 2/1993 |
| JP | 05301158 | | 11/1993 |
| JP | 06063499 | | 3/1994 |
| JP | 07304028 | | 11/1995 |
| JP | 08039428 | | 2/1996 |
| JP | 08270355 | | 10/1996 |
| JP | 09109032 | | 4/1997 |
| JP | 10337598 | | 12/1998 |
| WO | WO96/08301 | | 3/1996 |
| WO | WO96/33792 | | 3/1996 |
| WO | WO98/10895 | | 3/1998 |
| WO | WO98/16328 | | 3/1998 |
| WO | WO 9838411 | A2 * | 9/1998 |
| WO | WO02/49778 | | 6/2002 |

| | | | | |
|---|---|---|---|---|
| WO | WO03/055569 | | | 7/2003 |
| WO | WO2004/110589 | A1 | | 12/2004 |
| WO | WO2005/107963 | A2 | | 11/2005 |
| WO | WO2007/070559 | A2 | | 6/2007 |
| WO | WO 2008/042844 | A1 | | 4/2008 |
| WO | WO 2008050138 | A1 | * | 5/2008 |
| WO | WO2009/048783 | A2 | | 4/2009 |

OTHER PUBLICATIONS

U.S. Appl. No. 12/785,735 Office Action dated Dec. 9, 2011.
U.S. Appl. No. 12/490,492 Office Action dated Oct. 7, 2011.
U.S. Appl. No. 12/481,959 Final Office Action dated Oct. 27, 2010.
U.S. Appl. No. 12/481,959 Office Action dated Jun. 7, 2010.
U.S. Appl. No. 12/469,851 Final Office Action dated Nov. 9, 2010.
U.S. Appl. No. 12/469,851 Office Action dated Jun. 28, 2010.
U.S. Appl. No. 12/321,358 Final Office Action dated Jan. 18, 2012.
U.S. Appl. No. 12/321,358 Office Action dated Aug. 29, 2011.
U.S. Appl. No. 12/287,716 Office Action dated Jun. 17, 2011.
U.S. Appl. No. 12/287,709 Office Action dated Mar. 29, 2011.
U.S. Appl. No. 12/231,293 Office Action dated Sep. 13, 2011.
U.S. Appl. No. 12/228,670 Office Action dated Jun. 20, 2011.
U.S. Appl. No. 12/227,462 Final Office Action dated May 26, 2011.
U.S. Appl. No. 12/227,462 Office Action dated Nov. 15, 2010.
U.S. Appl. No. 12/008,980 Office Action dated Aug. 31, 2011.
U.S. Appl. No. 12/008,980 Office Action dated Apr. 5, 2011.
U.S. Appl. No. 12/001,479 Final Office Action dated Oct. 31, 2011.
U.S. Appl. No. 12/001,479 Office Action dated Jun. 8, 2011.
U.S. Appl. No. 11/897,976 Final Office Action dated Sep. 1, 2010.
U.S. Appl. No. 11/897,976 Office Action dated Apr. 1, 2010.
U.S. Appl. No. 11/897,975 Office Action dated Jun. 8, 2012.
U.S. Appl. No. 11/897,975 Final Office Action dated Aug. 12, 2011.
U.S. Appl. No. 11/897,975 Office Action dated Mar. 1, 2011.
U.S. Appl. No. 11/897,975 Final Office Action dated Jul. 21, 2010.
U.S. Appl. No. 11/897,975 Office Action dated Feb. 19, 2010.
U.S. Appl. No. 11/637,615 Final Office Action dated Nov. 16, 2011.
U.S. Appl. No. 11/637,615 Office Action dated Jul. 21, 2011.
U.S. Appl. No. 11/637,615 Final Office Action dated Aug. 2, 2010.
U.S. Appl. No. 11/637,615 Office Action dated Mar. 2, 2010.
International Search Report and Written Opinion from PCT/GB2008/050761 dated Sep. 17, 2009.
International Search Report and Written Opinion from PCT/GB2010/051050 dated Jan. 30, 2012.
EP Application No. 07 733 775.6 EPC Communication dated Dec. 9, 2010.
Polyamide 6/6—Nylon 6/6—PA 6/6 60% Glass Fibre Reinforced, Data Sheet [online], AZoM™, The A to Z of Materials and AZojomo, The "AZo Journal of Materials Online" [retrieved on Nov. 23, 2005] (2005) (Retrieved from the Internet: <URL: http://web.archive.org/web/20051123025735/http://www.azom.com/details.asp?ArticleID=493>.
Adams et al., "The Advanced Technology Linear Separator Model ATL-1000," Drexel Oilfield Services, STC 03, 18 pages (1991).
AMS 2000 Description, Thule Rigtech, Rig Technology, 18 pages (2000).
Automated Chemical Additive System, Thule Rigtech, Rig Technology Ltd., 4 pages (2000).
Brandt Automated Shaker Control, Varco, 1 page (2002).
Brandt®, A Varco Company, King Cobra Series, Installation, Operation, and Maintenance Manual, M12444 R5, 65 pages (2003).
Brandt®, A Varco Company, LCM-2D LP Installation and Operation Manual, 84 pages (1998).
Brandt et al., Mud Equipment Manual—Handbook 3: Shale Shakers, Gulf Pub. Co., 18 pages (1982).
The Derrick LP Sandwich Shaker, Derrick Equipment Company, 4 pages (1981).
Fluid Systems Inc., The Prodigy Series I™ Dynamic Control Shaker, 2 pages (Apr. 27, 2004).
Sweco® Oilfield Services, LM-3 Full-Flo™ Shale Shaker, 4 pages (1991).
Axiom Ax-1 Shaker Brochure, 24 pages (2010).
Brandt, VSM-300™ Shaker Brochure, 4 pages (2001).
Brandt, VSM-Ultra Shaker Brochure, 2 pages (2003).

* cited by examiner

RECLAMATION OF COMPONENTS OF WELLBORE CUTTINGS MATERIAL

CROSS-REFERENCE TO RELATED APPLICATIONS

This application is a continuation of U.S. patent application Ser. No. 12/469,851 filed on May 21, 2009, which is a division of U.S. patent application Ser. No. 11/543,301 filed on Oct. 4, 2006 and incorporated by reference herein for all they contain.

BACKGROUND OF THE INVENTION

1. Field of the Invention

The present invention is directed to systems and methods for reclaiming components of wellbore drilling cuttings mixtures; and in one aspect, to transferring dried lean phase cuttings materials to other systems.

2. Description of the Related Art

Drilling fluids—typically called "muds"—used in hydrocarbon well drilling, as well known in the prior art, pick up solid cuttings and debris which must be removed if the fluid is to be re-used. These fluids are typically water based or oil-based. Often a mud with various additives is pumped down through a hollow drill string (pipe, drill collar, bit, etc.) into a wellbore and exits through holes in a drillbit. The mud picks up cuttings, rock, other solids, and various contaminants, such as, but not limited to, crude oil, water influx, salt and heavy metals from the well and carries them upwardly away from the bit and out of the well in a space between the well walls and the drill string. The mud is pumped up the wellbore and at the top of the well the contaminated solids-laden mud is discharged, e.g., to a shale shaker which has a screen or a series of screens that catch and remove solids from the mud as the mud passes through them. If drilled solids are not removed from the mud used during the drilling operation, recirculation of the drilled solids can create weight, viscosity, and gel problems in the mud, as well as increasing wear on mud pumps and other mechanical equipment used for drilling.

The prior art discloses a variety of drill cuttings treatment methods and systems, and methods for reinjecting processed drilling fluid back into a well, including, but not limited to, as disclosed in U.S. Pat. Nos. 4,942,929; 5,129,469; 5,109,933; 4,595,422; 5,129,468; 5,190,645; 5,361,998; 5,303,786; 5,431,236; 6,640,912; 6,106,733; 4,242,146 and 4,209,381—all of these patents incorporated fully herein for all purposes. In one example of a typical prior art system, land-based or offshore (e.g. as shown in U.S. Pat. No. 5,190,645), a well is drilled by a bit carried on a string of drill pipe as drilling mud is pumped by a pump into the drill pipe and out through nozzles in the bit. The mud cools and cleans the cutters of the bit and then passes up through the well annulus flushing cuttings out with it. After the mud is removed from the well annulus, it is treated before being pumped back into the pipe. The mud enters a shale shaker where the relatively large cuttings are removed. The mud then enters a degasser where gas can be removed if necessary. The degasser may be automatically turned on and off, as needed, in response to an electric or other suitable signal produced by a computer and communicated to degasser. The computer produces the signal as a function of data from a sensor assembly associated with shale shaker. The mud then passes to a desander and (or a desilter), for removal of smaller solids picked up in the well. In one aspect, the mud next passes to a treating station where, if necessary conditioning media, such as barite, may be added. Suitable flow controls e.g. a valve, control the flow of media. The valve may be automatically operated by an electric or other suitable signal produced by the computer as a function of the data from sensor assembly. From the treatment station, the mud is directed to a tank from which a pump takes suction, to be re-cycled through the well. The system shown is exemplary; additional components of the same types (e.g. additional treatment stations) or other types (e.g. centrifuges) are be included.

In another prior art system (e.g. as disclosed in U.S. Pat. No. 6,106,733) cuttings, debris, material, soil and fluid from a drilling operation in a wellbore W are conveyed to a shaker system. Separated oily solids (cuttings, soil, etc.) are conveyed with a conveyor (a pump may be used) to a thermal treatment system. The thermal treatment system produces a discharge of treated solids suitable for disposal and a stream containing liquids (e.g. oil and water).

In certain prior art systems and methods on an offshore rig wet cuttings, produced, e.g., by shale shakers, are mixed with sea water to form a mixture with a desired mud weight and viscosity which, in some aspects, results in a pumpable slurry. The resulting drilling fluid is then fed to a known cuttings reinjection system or to storage. Wet material generally weighs more and can occupy more volume than dry material.

A variety of problems are associated with certain prior art systems and methods which begin with wet drilling material, "wet" being defined as the fluid content of material taken directly from shale shakers. Cohesive bridging and arching of wet material are problems associated with attempts to process wet material to recover reusable drilling fluid.

There has long been a need for an effective and efficient system for treating drilling mixtures to recover reusable fluid and to process cuttings material for transfer and, in some cases, for reinjection into the earth. There has long been a need, recognized by the present inventor, for such systems which deal with dry drill cuttings material so it can be effectively handled and reinjected into the earth and which reduce the volume of cuttings material for ease of handling and economies of scale.

BRIEF SUMMARY OF THE INVENTION

The present invention teaches methods for reclaiming component materials from a drill cuttings mixture of drilling fluid and cuttings material, the methods in certain aspects including: flowing a drill cuttings mixture of drilling fluid and cuttings material to a dryer; producing with the dryer dry cuttings material; and conveying with a conveyor system the dry cuttings material to a secondary system, the conveyor system including a positive pressure pneumatic conveying apparatus for conveying the dry cuttings material to the secondary system.

The present invention teaches systems for separating drilling mixture components and for reinjecting cuttings material into a wellbore, the systems in certain aspects including: a dryer for producing dry cuttings material from a cuttings mixture of drilling fluid and cuttings material, the dryer in certain aspects for reducing in size pieces of material fed to it and, in one aspect, reducing material to powder; and a conveying system for conveying the dry cuttings material to a secondary system, e.g. a thermal treatment system or a reinjection apparatus, the conveying system including positive pressure pneumatic conveying apparatus.

The present invention discloses, in certain embodiments, a wellbore cuttings component reclamation system that processes cuttings material from a wellbore drilling mixture and treats the cuttings material to produce acceptably disposable material (in certain aspects for transfer to a thermal treatment facility and subsequent landfill disposal; or for reinjection, e.g. into a dedicated reinjection well or through an open annulus of a previous well into a fracture, e.g. a fracture created at a casing shoe set in a suitable formation and, in certain aspects, recyclable drilling fluid. Such systems may be land-based or configured for offshore use.

In certain embodiments, a system according to the present invention has cuttings material processed by a dryer, e.g. a vortex dryer, that produces relatively dry material containing primarily drill cuttings material and some drilling fluid. In one aspect "dry" material is material that is a powder-like substance able to be transferred or conveyed in lean (or "dilute") phase (i.e. substantially all particulates contained in an air stream are airborne), facilitating transfer by a positive pressure pneumatic conveyor. Using a dryer that produces both dried cuttings material and drilling fluid can, according to the present invention, optimize or maximize the reclamation of drilling fluid ("mud") and minimize the volume of cuttings material to be transported and/or treated prior to disposal. In certain aspects, by passing the cuttings material through a Vortex dryer or similar apparatus, the size of pieces of cuttings material is reduced and the transfer of such material is thereby facilitated; in one aspect, a Vortex dryer produces a powder from input cuttings material. In many instances, additional grinding of the material by an appropriate grinder apparatus facilitates treatment of the material by a shaker. Broken down material is slurrified more easily than relatively larger material; e.g., when, for reinjection, the material is mixed with seawater. By using a dryer that reduces size of material, wear and tear on downstream grinders is reduced. Using a positive pressure pneumatic conveying apparatus, dried cuttings material can be dosed into a treatment facility in a controlled manner.

Accordingly, the present invention includes features and advantages which are believed to enable it to advance drill cuttings conveyance technology. Characteristics and advantages of the present invention described above and additional features and benefits will be readily apparent to those skilled in the art upon consideration of the following detailed description of preferred embodiments and referring to the accompanying drawings.

Certain embodiments of this invention are not limited to any particular individual feature disclosed here, but include combinations of them distinguished from the prior art in their structures, functions, and/or results achieved. Features of the invention have been broadly described so that the detailed descriptions that follow may be better understood, and in order that the contributions of this invention to the arts may be better appreciated. There are, of course, additional aspects of the invention described below and which may be included in the subject matter of the claims to this invention. Those skilled in the art who have the benefit of this invention, its teachings, and suggestions will appreciate that the conceptions of this disclosure may be used as a creative basis for designing other structures, methods and systems for carrying out and practicing the present invention. The claims of this invention are to be read to include any legally equivalent devices or methods which do not depart from the spirit and scope of the present invention.

What follows are some of, but not all, the objects of this invention. In addition to the specific objects stated below for at least certain preferred embodiments of the invention, there are other objects and purposes which will be readily apparent to one of skill in this art who has the benefit of this invention's teachings and disclosures. It is, therefore, an object of at least certain preferred embodiments of the present invention to provide:

New, useful, unique, efficient, non-obvious systems and methods for the reclamation of drilling material components and which treat drill cuttings material to produce conveyable dry drill cuttings material conveyable by positive pressure pneumatic conveying apparatus on land-based or offshore drilling rigs;

Such systems and methods that provide for further treatment and/or processing of relatively dry cuttings material, including, but not limited to reinjection and thermal treatment; and Such systems and methods that reclaim re-usable re-cyclable drilling fluids.

It will be understood that the various embodiments of the present invention may include one, some, or all of the disclosed, described, and/or enumerated improvements and/or technical advantages and/or elements in claims to this invention.

BRIEF DESCRIPTION OF THE DRAWINGS

A more particular description of embodiments of the invention briefly summarized above may be had by references to the embodiments which are shown in the drawings which form a part of this specification. These drawings illustrate certain preferred embodiments and are not to be used to improperly limit the scope of the invention which may have other equally effective or equivalent embodiments.

Figure 1:
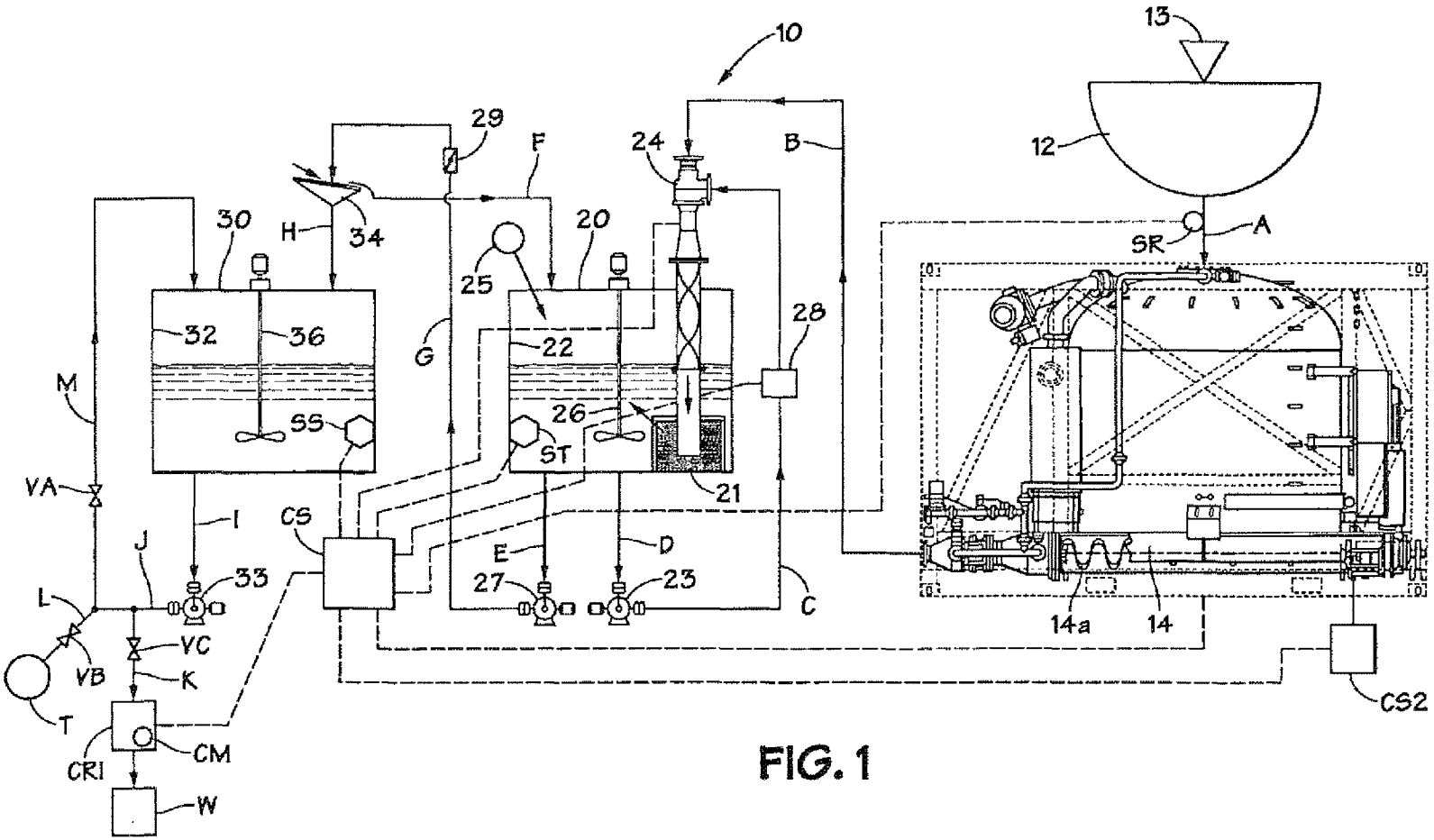
FIG. 1 is a schematic view of a system according to the present invention.

Presently preferred embodiments of the invention are shown in the above-identified figures and described in detail below. It should be understood that the appended drawings and description herein are of preferred embodiments and are not intended to limit the invention or the appended claims. On the contrary, the intention is to cover all modifications, equivalents and alternatives falling within the spirit and scope of the invention as defined by the appended claims. In showing and describing the preferred embodiments, like or identical reference numerals are used to identify common or similar elements. The figures are not necessarily to scale and certain features and certain views of the figures may be shown exaggerated in scale or in schematic in the interest of clarity and conciseness.

As used herein and throughout all the various portions (and headings) of this patent, the terms "invention", "present invention" and variations thereof mean one or more embodiment, and are not intended to mean the claimed invention of any particular appended claim(s) or all of the appended claims. Accordingly, the subject or topic of each such reference is not automatically or necessarily part of, or required by, any particular claim(s) merely because of such reference.

DETAILED DESCRIPTION OF THE INVENTION AND THE PREFERRED EMBODIMENT

As shown in FIG. 1, one particular embodiment of a system 10 according to the present invention has a system 12 with a dryer 13 for producing dry cuttings material and then feeding the dry cuttings material in a line A to a system 14, a positive pressure pneumatic conveying system that selectively conveys the dry material into the line B (for eventual reinjection).

In one particular aspect the system 14 is a system as disclosed in co-owned U.S. Pat. Nos. 6,936,092 and 6,988,567 and U.S. application Ser. No. 10/875,083 filed Jun. 22, 2004, all incorporated fully herein for all purposes. In one aspect the dryer produces dried cuttings material in a powder-like form.

A sensor SR on the line A senses moisture content of the material in the line and conveys this information to a control system CS (e.g., but not limited to a control system as disclosed in the co-owned patents and U.S. patent applications listed above) which can shut down flow from the system 12. The control system CS controls the various items, devices and apparatuses in the system 10 and, in one aspect, communicates with a control system CM of a cuttings reinjection system CRI. The control system CS can adjust the flow rate of dried material to a blender 24 using a standard PID algorithm with a setpoint based on acceptable density, feedback for which is obtained from a meter of the CRI system.

Material in a line B is conveyed to the blender 24. Water (or sea water) from a tank 22 is circulated in lines D and C to the blender 24 by a pump 23. The pump 23 pumps liquid from the tank 22 which mixes with the inflowing air flow from the line B in the blender 24. A viscosity/density meter 28 provides the control system CS with information regarding the viscosity and density of the material flowing from the tank 22. The cuttings material and water mix together and are pumped by the pump 23 through a screen 21 into the tank 22 of a first stage 20 of the system 10.

Water (or sea water) as needed is fed into the tank 22 by a pumping system 25. An agitator 26 helps maintain solids in suspension in the tank 22.

Density (and weight) and viscosity of the mixture in the tank 22 are sensed by sensors (e.g. meter 28, sensor ST) which convey sensed levels of density, weight, and viscosity to the control system CS, and, as needed, are adjusted by changing the feed from the system 14 using a control system CS 2 for the system 14 with the control system CS in communication with the control system CS 2. A resulting slurry of the material is pumped by a pump 27 in a line E to a line G to a tank 32 or, optionally, first to a shaker system 34. A control valve 29 selectively controls flow in the line G. When the tank's contents are at an acceptable density and/or viscosity, the valve 29 is opened, flow in Line B ceases, and the tank is emptied into the line G sending a batch of material to the tank 32. The shaker system 34 removes oversize solids returned in a line F back to the tank 22; and drilling fluid with particles of material of an acceptable size (which pass through the shaker's screens) is fed in a line H to the tank 32 of a second stage 30. Sensors SS sense levels of density, weight and viscosity of the material in the tank 32 and convey this information to the control system CS. As needed, weight and viscosity are adjusted. An agitator 36 agitates the contents of the tank 32. A discharge rate of the system 14 is adjustable via adjusting a variable speed metering screw 14*a* of the system 14.

Drilling fluid is pumped in lines I, J and K by a pump 33 for injection into a wellbore W e.g., for drilling operations employing pumped drilling fluid with valves VA and VB closed and valve VC open. Optionally, the pump 33 pumps material to the cuttings reinjection ("CRI") system which may include a or several first stage booster pump(s) for a or several triplex pump(s) or similar pump(s) useful in cuttings reinjection.

Optionally, with valves VA and VC closed, the material from the tank 32 is pumped by the pump 33 in the line I, J, L to a storage facility T through valve VB. Optionally with the valves VB and VC closed, the pump 33 pumps material from the tank 32 in the lines I, J, M back into the tank 32 through valve VA for storage and/or further processing.

Figure 2:
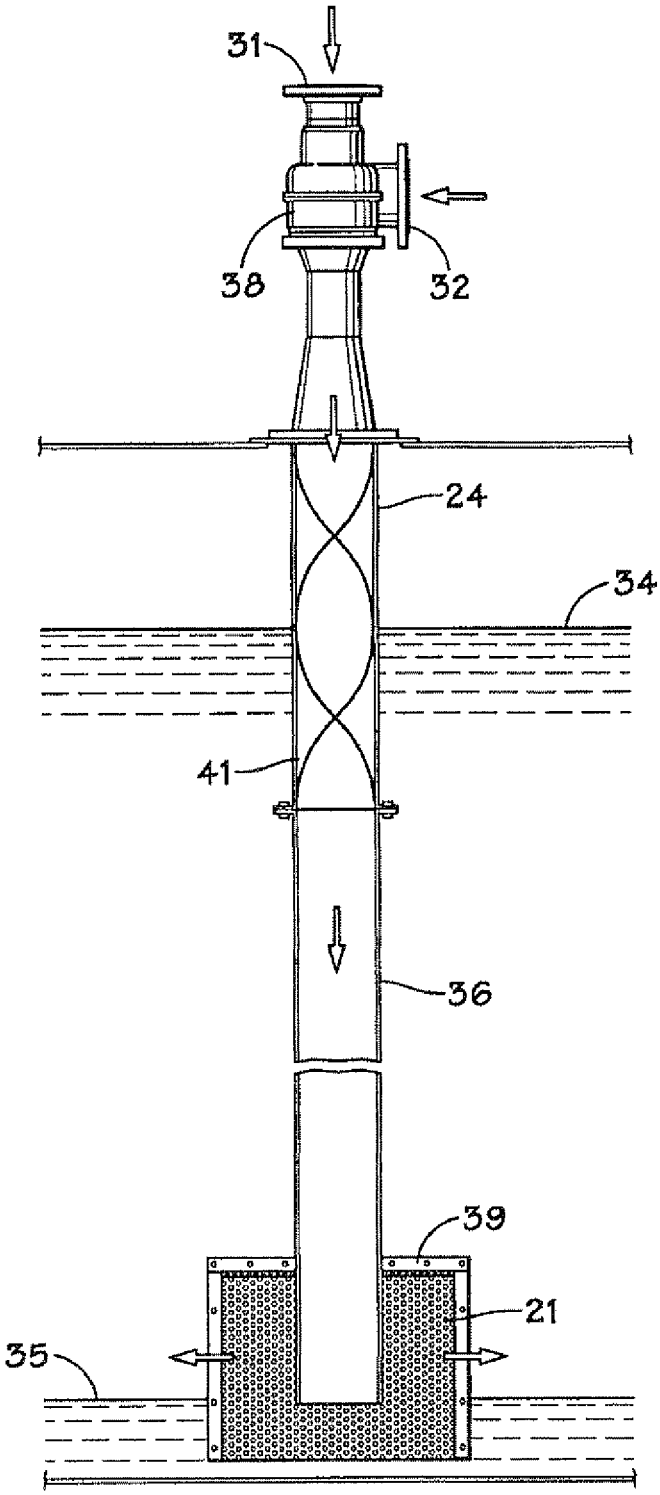
FIG. 2 is a side view in cross-section of part of the system of FIG. 1 showing a mixer.
Figure 3:
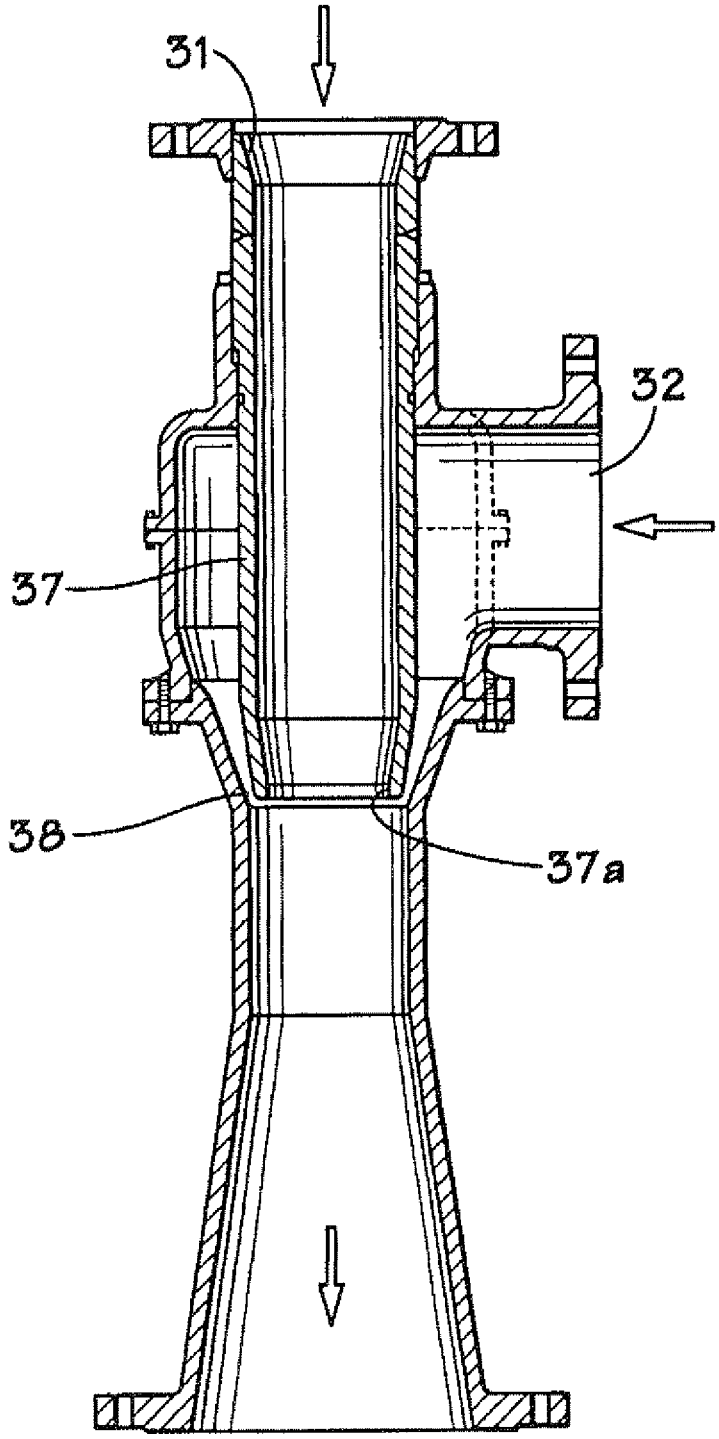
FIG. 3 is a side view in cross-section of part of the mixer in FIG. 2.

Any suitable known blender or mixer can be used for the blender 24 (e.g. a high shear mixing unit or mixer). In one aspect, as shown in FIGS. 2 and 3, the blender 24 has an inlet 31 in an upper body 38 into which dry material flows from the system 14, e.g. in a continuously flowing air-conveyed stream. Liquid recirculated from the tank 22 flows into an inlet 32, sucking material from the inlet 32. A mixer 41, e.g. an in-line static ribbon mixer, mixes the various flows. The material flows down a pipe 36 to a diffuser 39 which has a screen (or screens) 21 through which the material flows into the tank 22. Numeral 34 indicates a typical level of material in the tank 22 and numeral 35 indicates a low level of the material. Dried material from the dryer 13 is reduced in size by the dryer. This lightens the load on downstream grinders and increases the efficiency of the blender 24 and results in a focused high energy interaction between the relatively smaller solids (in powder form) and water (e.g. seawater), optimizing or maximizing resultant homogeneity of the mixture fed to the tank 22. Wear, tear and downtime of downstream grinders, e.g. grinder pumps of a CRI system are reduced due to the flow of the size-reduced material from the dryer.

As shown in FIG. 3 the body 38 includes an interior flow member 37 through which the dry material flows and exits from an outlet 37*a* to mix with the incoming liquid flowing in from the inlet 32.

Figure 4:
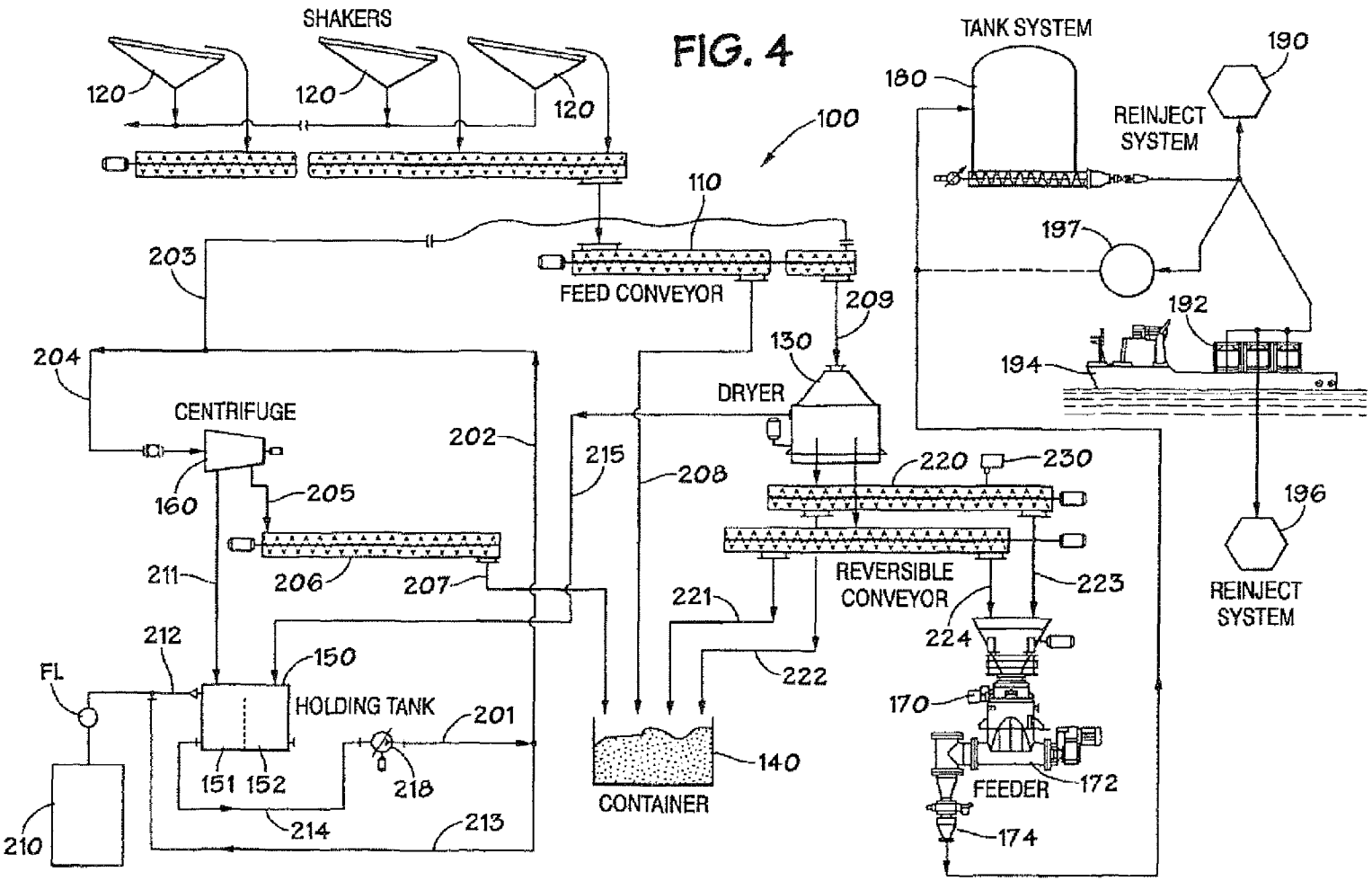
FIG. 4 is a schematic view of a system according to the present invention.

FIG. 4 illustrates a system 100 according to the present invention in which a feed conveyor 110 conveys drill cuttings material processed by shakers 120 (e.g. on a land rig or offshore rig) either to a dryer 130 or to a cuttings container 140. Recovered well drilling fluid (with some solids) from the dryer 130 is, optionally, fed in a line 215 to a holding tank 150 and then to a centrifuge 160 for centrifugal processing. Dried cuttings material from the dryer 130 is fed by a conveyor system 220 to a feeder system 170 (a positive pressure pneumatic conveying system), with a feeder 172 and an outlet 174, to a tank system 180 from which it is fed to a cuttings reinjection system 190.

Optionally, cuttings material from the tank system 180 is fed to a storage system 192 on a vessel 194 from which it is subsequently introduced to a cuttings reinjection system 196 at another site or rig. The system 170 can send the material to the tank system 180 and/or the tank system 180 can send the material to the system 190. The system 100 may have a control system like the system CS, FIG. 1.

In one particular aspect the dryer 130 is a vortex dryer, e.g. a commercially available National Oilwell Varco Brandt Vortex Dryer which, optionally, can be flushed with liquid material from the holding tank 150 via lines 201, 202, 203. Via lines 201, 202 and 204 material from the tank 150 is fed to the centrifuge 160. Solids output by the centrifuge 160 flow in a line 205 to a conveyor 206 which transfers the solids in a line 207 to the container 140. The holding tank 150 is a weir tank with a middle weir dividing the tank into two sides 151, 152.

The feed conveyor 110 feeds material in a line 208 to the container 140 and in a line 209 to the dryer 130. Recovered material flows from the dryer 130 to the tank 150 in a line 215. Drilling fluid from the centrifuge 160 flows in a line 211 back to the tank 150. Reusable drilling fluid flows from the tank 150 in a line 212 to a rig mud system 210. Optionally, this fluid flows through a filtration system FL prior to introduction to the system 210. Material in a line 214 from a side 151 of the tank 150 is fed back to the centrifuge in a line 201. Material flows in a line 213 to the line 212. A pump 218 pumps material in the line 201.

The system 170, which receives dry material from the dryer 130, including a positive pressure pneumatic conveying system, including, e.g., those disclosed in the two U.S. patents and the pending U.S. patent application referred to above. Dry material from the dryer 130 is fed by the reversible conveyor 220 to the system 170 in lines 223, 224. A moisture meter 230 measures the moisture level of material from the dryer 230 and, if the material's moisture content exceeds a pre-set level (e.g. 10% by weight)—a level at which conveyance by the positive pressure pneumatic conveying apparatus would be impeded or prevented—the reversible conveyor 220 reverses and the material is fed in the lines 221, 222 to the container 140. In one aspect the dryer is a vortex dryer that produces the dry cuttings material as dry powder in lean phase.

Suitable valves, check valves, filters, flow controllers and controls for them are used on the lines of the system 100.

Dry material from the system 170 is moved, in one aspect, to a suitable storage and processing system, e.g. a tank system 180 which may be any tank or vessel (or tanks or vessels) disclosed in the two U.S. patents and the U.S. patent application referred to above, including a vessel (land-based; on a rig; on a ship) which doses material to an apparatus or system (e.g. to the system 190 or to the system 196). The reinjection systems 190 and 196 may be like that of FIG. 1 or they may be any suitable known cuttings reinjection system for reinjecting material into a wellbore.

In one particular aspect, if the moisture sensor 230 indicates that screens in the dryer 130 are blinding (indicating the moisture content of the material is too high for the conveying system to convey or to effectively convey the material), material from the dryer 130 is directed in the line 222 to the container 140. Optionally, material from the system 170 is fed to a thermal treatment system 197 (from which it can then be transferred to the system 190 or to a transport for transfer to the system 196. As with the transfer of material to the system 190, material can be sent directly from the system 170 to the system 197, or to the system 180 and then to the system 197.

The present invention, therefore, provides in some, but not necessarily all, embodiments a method for reclaiming component materials from a drill cuttings mixture of drilling fluid and cuttings material, the method including: flowing a drill cuttings mixture of drilling fluid and cuttings material to a dryer; producing with the dryer dry cuttings material; and conveying with a conveyor system the dry cuttings material to a secondary system, the conveyor system including a positive pressure pneumatic conveying apparatus for conveying the dry cuttings material to the secondary system. Such a method may include one or some, in any possible combination, of the following: wherein the secondary system is a cuttings reinjection system, the method further including reinjecting the dry cuttings material into a wellbore using the cuttings reinjection system; sensing moisture content of the dry cuttings material; if the moisture content indicates that the dry cuttings material will impede conveyance by the conveyor system, diverting the dry cuttings material away from the positive pressure pneumatic conveying apparatus; producing with the dryer a drilling fluid mixture with some solids from the drill cuttings mixture, and flowing the produced drilling fluid mixture from the dryer with some solids to a holding system; flowing the drilling fluid mixture from the holding system to a rig mud system; flowing drilling fluid mixture from the holding system to a centrifuge for processing by the centrifuge to produce centrifuged solids and centrifuged drilling fluid; flowing the centrifuged drilling fluid to the holding system; the conveyor system including a reversible conveyor, the method further including reversing the reversible conveyor to prevent dry drill solids from the dryer from flowing to the positive pressure conveying apparatus; wherein the secondary system is a thermal treatment system, the method further including treating the dry cuttings material with the thermal treatment system; dosing material from the positive pressure pneumatic conveying apparatus to the secondary system; wherein a primary control system controls operations of the system and a secondary control system controls the cuttings reinjection system, the secondary control system in communication with the primary control system, the method further including adjusting using the primary control system a rate of feed of material to a mixer, and feeding material from the mixer to the cuttings reinjection system; wherein the secondary control system provides density measurements from a density meter to the primary control system, the primary control system taking said measurements into account in said adjusting; wherein the cuttings material includes pieces of material, each piece having a size, the method further including the dryer reducing the size of said pieces; and/or wherein the dryer reduces the pieces to powder.

The present invention, therefore, provides in some, but not necessarily all, embodiments a method for reclaiming component materials from a drill cuttings mixture of drilling fluid and cuttings material, the method including: flowing a drill cuttings mixture of drilling fluid and cuttings material to a dryer; producing with the dryer dry cuttings material; conveying with a conveyor system the dry cuttings material to a reinjection system, the conveyor system including a positive pressure pneumatic conveying apparatus for conveying the dry cuttings material; reinjecting the dry cuttings material into a wellbore using the reinjection system; sensing moisture content of the dry cuttings material; the conveyor system having a reversible conveyor, the method further including if the moisture content of the dry cuttings material is of such a level that conveyance by the conveyor system would be impeded, reversing the reversible conveyor to prevent dry cuttings material from the dryer from flowing to the positive pressure conveying apparatus.

The present invention, therefore, provides in some, but not necessarily all, embodiments a system for separating drilling mixture components and for reinjecting cuttings material into a wellbore, the system including: a dryer for producing dry cuttings material from a cuttings mixture of drilling fluid and cuttings material; a conveying system for conveying the dry cuttings material to a reinjection apparatus, the conveying system having positive pressure pneumatic conveying apparatus; and a thermal treatment apparatus or a reinjection apparatus for reinjecting the dry cuttings material into a wellbore. Such a method may include one or some, in any possible combination, of the following: a moisture sensor for sensing moisture content of the dry cuttings material, and the conveyor system further having a reversible conveyor, the reversible conveyor for feeding the dry cuttings material to the positive pressure pneumatic conveying apparatus and for reversing, if the moisture content of the dry cuttings material is such that conveyance by the positive pressure pneumatic conveying apparatus would be impeded, so that the dry cuttings material do not flow to the positive pressure pneumatic conveying apparatus; a centrifuge for receiving a drilling fluid stream from the dryer, the drilling fluid stream containing reclaimable drilling fluid, and the centrifuge for processing the drilling fluid stream from the dryer producing reusable drilling fluid; and/or wherein the dryer is for reducing in size the size of pieces of cuttings material, in one aspect, to powder.

In conclusion, therefore, it is seen that the present invention and the embodiments disclosed herein are well adapted to carry out the objectives and obtain the ends set forth. Certain changes can be made in the subject matter without departing from the spirit and the scope of this invention. It is realized that changes are possible within the scope of this invention and it is further intended that each element or step recited herein is to be understood as referring to the step literally and/or to all equivalent elements or steps. This specification is intended to cover the invention as broadly as legally possible in whatever form it may be utilized. All patents and applications identified herein are incorporated fully herein for all purposes.

What is claimed is:

1. A system, comprising:

a dryer that is adapted to receive a drill cuttings mixture comprising drilling fluid and cuttings material, said dryer being further adapted to treat said drill cuttings mixture by drying said cuttings material below a preselected moisture content level;

a moisture sensor that is adapted to sense a moisture content of said cuttings material after said cuttings material is dried by said dryer;

a cuttings reinjection system that is adapted to reinject said cuttings material dried by said dryer into a well bore; and a conveyor system that is adapted to convey said cuttings material dried by said dryer to said cuttings reinjection system, said conveyor system comprising a positive pressure pneumatic conveying apparatus.

2. The system of claim 1, wherein said conveyor system further comprises a cuttings diversion apparatus that is adapted to divert said cuttings material dried by said dryer away from said positive pressure pneumatic conveying apparatus when said moisture content of said cuttings material sensed by said moisture sensor exceeds said preselected moisture content level.

3. The system of claim 2, wherein said cuttings diversion apparatus comprises a reversible conveyor.

4. The system of claim 3, wherein said reversible conveyor is adapted to convey said cuttings material dried by said dryer to said positive pressure pneumatic conveying apparatus when said moisture content of said cuttings material sensed by said moisture sensor is below said preselected moisture content level.

5. The system of claim 1, wherein said dryer is further adapted to produce a drilling fluid mixture comprising some solids material from said drill cuttings mixture, the system further comprising a holding system that is adapted to receive a flow of said drilling fluid mixture from said dryer.

6. The system of claim 5, further comprising a drilling mud system that is adapted to receive a flow of said drilling fluid mixture from said holding system.

7. The system of claim 5, further comprising a centrifuge that is adapted to receive a flow of said drilling fluid mixture from said holding system and to produce centrifuged solids and centrifuged drilling fluid.

8. The method of claim 7, wherein said centrifuge is further adapted to return a flow of said centrifuged drilling fluid to said holding system.

9. The system of claim 1, further comprising a thermal treatment system, wherein said positive pressure pneumatic conveying apparatus is further adapted to convey at least a portion of said cuttings material dried by said dryer to said thermal treatment system.

10. The system of claim 9, wherein said thermal treatment system is adapted to further treat said at least said portion of said cuttings material received from said positive pressure pneumatic conveying apparatus and to feed said further treated cuttings material to said cuttings reinjection system.

11. The system of claim 1, further comprising a primary control system that is adapted to control said conveyor system.

12. The system of claim 11, further comprising a mixer system that is adapted to receive a feed of said cuttings material dried by said dryer from said conveyor system and generate a feed of mixed material to said cuttings reinjection system, wherein said primary control system is adapted to adjust a rate of said feed of said cuttings material by said conveyor system to said mixer system.

13. The system of claim 12, wherein said mixer system comprises a density meter that is adapted to measure a density of said mixed material generated by said mixer system.

14. The system of claim 13, further comprising a secondary control system that is adapted to provide said measured density of said mixed material generated by said mixer system from said density meter to said primary control system.

15. The system of claim 14, wherein said secondary control system is further adapted to control said cuttings reinjection system.

16. The system of claim 12, wherein said mixer system comprises first mixing stage equipment, said first mixing stage equipment comprising a first tank, a first agitator, and a blender.

17. The system of claim 16, wherein said mixer system further comprises second mixing stage equipment, said second mixing stage equipment comprising a second tank and a second agitator.

18. The system of claim 12, wherein said mixer system further comprises a plurality of circulation pumps.

19. The system of claim 1, wherein said dryer is adapted to reduce a size of material pieces comprising said cuttings material.

20. A system, comprising:

a dryer that is adapted to receive a drill cuttings mixture comprising drilling fluid and cuttings material, said dryer being further adapted to treat said drill cuttings mixture by drying said cuttings material below a preselected moisture content level and producing a drilling fluid mixture comprising some solids material from said drill cuttings mixture;

a moisture sensor that is adapted to sense a moisture content of said cuttings material dried by said dryer;

a cuttings reinjection system that is adapted to reinject said cuttings material dried by said dryer into a well bore;

a conveyor system comprising a reversible conveyor and a positive pressure pneumatic conveying apparatus that is adapted to convey said cuttings material dried by said dryer from said reversible conveyor to said cuttings reinjection system;

a holding system that is adapted to receive a flow of said drilling fluid mixture from said dryer; and a centrifuge that is adapted to receive a flow of said drilling fluid mixture from said holding system and to produce centrifuged solids and centrifuged drilling fluid.

21. The system of claim 20, further comprising:

a primary control system that is adapted to control said conveyor system; and a mixer system that is adapted to receive a feed of said cuttings material dried by said dryer from said conveyor system and generate a feed of mixed material to said cuttings reinjection system, wherein said primary control system is adapted to adjust a rate of said feed of said cuttings material by said conveyor system to said mixer system.

* * * * *